US005775066A

United States Patent [19]

Lamaire

[11] Patent Number: 5,775,066

[45] Date of Patent: Jul. 7, 1998

[54] DEVICE FOR THE DISTRIBUTION OF BULK ARTICLES AND USE OF SUCH A DEVICE

[75] Inventor: José Lamaire, Vleteren, Belgium

[73] Assignee: Bart Lamaire, Vleteren, Belgium

[21] Appl. No.: 600,164

[22] Filed: Feb. 12, 1996

[51] Int. Cl.[6] ..... B65B 1/32; B65B 25/04; B65B 37/00; B65B 59/04

[52] U.S. Cl. ..... 53/502; 53/475; 53/201; 53/244

[58] Field of Search ..... 53/502, 475, 473, 53/201, 244, 391, 390, 501

[56] References Cited

U.S. PATENT DOCUMENTS

| | | | |
|---|---|---|---|
| 3,241,625 | 3/1966 | Soojian | 53/502 X |
| 3,691,716 | 9/1972 | Fogg | 53/502 |
| 3,695,371 | 10/1972 | Sheetz | 177/59 |
| 3,705,475 | 12/1972 | Riley | 53/502 X |
| 3,720,039 | 3/1973 | Warkentin | 53/502 X |
| 3,720,276 | 3/1973 | Banks | 177/122 |
| 3,738,077 | 6/1973 | Leach | 53/502 |
| 4,398,653 | 8/1983 | Daloisio | 222/185 |
| 4,607,478 | 8/1986 | Maglecic | 53/502 |
| 4,999,977 | 3/1991 | Briscoe et al. | 53/501 |
| 5,001,889 | 3/1991 | Mueller | 53/502 |
| 5,095,959 | 3/1992 | Komassa et al. | 141/114 |
| 5,121,775 | 6/1992 | McClain | 141/83 |
| 5,331,792 | 7/1994 | Kitchen | 53/502 |
| 5,339,607 | 8/1994 | Regier | 53/502 X |

FOREIGN PATENT DOCUMENTS

| | | |
|---|---|---|
| 00565157 | 7/1982 | European Pat. Off. . |
| 68295 | 6/1929 | Luxembourg . |
| 9002081 | 3/1990 | WIPO . |

*Primary Examiner*—James F. Coan

*Attorney, Agent, or Firm*—James Creighton Wray; Meera P. Narasimhan

[57] ABSTRACT

Device for the distribution of bulk articles, comprising a supporting structure (1), to which there is fastened a conveyor (6), and a stock container (11) having a discharge opening (25) which can be closed off by a slide valve (13), the stock container (11) being disposed exchangeably on the supporting structure (1) above the conveyor (6), and the conveyor (6) being able to be drive so as to transport bulk articles, leaving the stock container (11) along the discharge opening (25), and drop them into a packaging. Use of a device for the distribution of bulk articles as an apparatus in the sale of bulk articles in a shop.

15 Claims, 2 Drawing Sheets

DEVICE FOR THE DISTRIBUTION OF BULK ARTICLES AND USE OF SUCH A DEVICE

BACKGROUND OF THE INVENTION

The present invention relates to a device for the distribution of bulk articles, comprising a stock container, provided with a discharge opening, and a conveyor, which can be driven so as to transport bulk articles, leaving the stock container along the discharge opening, and drop them into a packaging.

Devices having the above-described characteristics are known from European patent application No. 81 305 065.5 (publication no. 0 056 515) and from U.S. Pat. No. 3,720,276.

The device described in this European patent application comprises a fixedly disposed feed trough having a discharge opening, beneath which there is disposed a conveyor belt which can be driven so as to transport the bulk articles falling from the feed trough and drop them into a collecting trough. This device also further comprises a weighing installation for determining the weight of the bulk articles conducted to the collecting trough.

The device described in the U.S. patent comprises two feed troughs, the discharge openings of which are disposed above respective conveyor belts. These conveyor belts are provided so as to transport the bulk articles to a collecting trough of a weighing scale, whence a predetermined weight of bulk articles is repeatedly conducted to a packaging machine. This device is particularly provided so as to distribute bulk articles, such as potatoes, in quantities of roughly the same weight, before the quantities in question are respectively packed in closed packagings. By providing large specimens of a specific article in the one feed trough and providing small specimens of that article in the other feed trough and by controlling the flow of articles from both conveyor belts to the weighing scale, it is possible to obtain quantities, to be packed, of the bulk article, the weight of which quantities can be approximated with great precision to a predetermined weight.

In U.S. Pat. No. 3,720,039, a device is described which comprises a conveyor bolt for supplying bulk articles (such as potatoes) such that they fall into a box to be filled. Whilst it is filled, the box stands on a weighing scale provided with means, depending upon the weight of the articles in the box, for lowering the drive velocity of the conveyor belt or for halting the conveyor belt for the purpose of introducing into the box a quantity of articles, the weight of which conforms as precisely as possible to a predetermined weight. This device does not contain a stock container.

In the known devices in which a stock container is provided, this is fixedly disposed above the conveyor belt.

In order to top up the stock container, it is consequently necessary to conduct the bulk articles from a storage site to the device and drop them on the spot into the stock container. This can be done with a transport means, such as a truck or the like, or can also be continuously realized by means of a conveyor belt.

The latter, however, is an expensive solution. In some usage situations (where the device is stored in a relatively small room, for example), the device cannot be reached by truck and a conveyor belt occupies too much space. The stock container then has to be manually filled, which is very time-consuming and arduous.

For these reasons, inter alia, this method of filling the stock container is not feasible for all usage situations of the device.

Some articles such as fruit or vegetables (potatoes, for example) are soon damaged if they fall onto a surface or one upon the other.

In the case of the known devices, these articles must first be loaded from the storage site onto a transport means or conveyor belt, whence they must subsequently be dropped into the stock container. The risk of damaging the articles is therefore incurred twice.

SUMMARY OF THE INVENTION

The object of the present invention consists in remedying these drawbacks.

This object in achieved by providing the device for the distribution of bulk articles with a removable stock container.

The bulk articles are loaded at the storage site into the stock container. This stock container is afterwards conducted to the device and placed upon it. In this way, the risk of damaging the articles is incurred only once.

In this way, delicate bulk articles are far less damaged, thereby enabling bulk articles of higher quality to be offered.

In a preferred embodiment of the device according to the present invention, this in provided with a weighing device for weighing the quantity of bulk articles which has ended up in a packaging and with an adjustable control device for switching off a drive device of the conveyor once a preset weight of bulk articles is weighed by the weighing device. A user who wishes to have a specific weight of bulk articles end up in a packaging can achieve this in a very simple and user-friendly manner using the device according to the present invention. The filling of the packaging is indeed automatically halted, once the preset, desired weight is reached.

In order to be able to open and close the discharge opening of a filled stock container without damaging the bulk articles, the stock container is preferably provided with a slide valve. The most preferred embodiment of the stock container is obtained by providing the stock container with walls which obliquely converge in the direction of the base, whilst the discharge opening is provided in the base of the stock container. A stock container of this kind permits easy emptying. The bulk articles in the stock container are indeed guided by the walls towards the discharge opening.

In yet another preferred embodiment of this device, a brush cut-off is provided so as to prevent bulk articles from falling from the conveyor when this conveyor in not driven. When the conveyor drive is switched off, the fall of the articles into the packaging is halted almost immediately.

The conveyor is switched off manually or automatically at the moment when the desired quantity of articles is present in the packaging. The brush cut-off prevents further articles, once the conveyor has been switched off, from falling into the packaging or—following removal of the packaging—from falling onto the spot where a packaging should have been placed.

If the container in provided on the bottom side with supporting legs, it can, on the one hand, be easily lifted by a transport means having a lifting device, such as a forklift truck, for example. In addition, the stock container can thereby rapidly be placed at the exact spot on the device.

As a result of the stock container being provided with smooth, wooden inner walls, the bulk articles slide easily towards the discharge opening, which facilitates easy emptying and reduces the risk of the articles being damaged.

In a most preferred embodiment of the device, the conveyor is fastened to a supporting structure for the stock container. A device of this kind has a relatively simple and compact construction.

The present invention also further relates to the use of a device for the distribution of bulk articles.

The sale of bulk articles in a shop has hitherto been conducted as follows:

At a location which is accessible to the customer, there is provided, on the one hand, a stock of bulk articles and, on the other hand, a stock of disposable packagings. The customer can fill a packaging by hand with the desired quantity of bulk articles. Generally, a weighing scale is likewise provided so as to allow the customer to weigh the articles placed in the packaging. The price is then either determined automatically and printed on a label which has to be affixed to the packaging by the customer or it is determined by weighing at the till.

This method of selling bulk articles calls for disposable packagings, which are detrimental to the environment and influence the selling price.

In view of the fact that a stock of a specific bulk article contains articles of differing quality, each customer, in filling a packaging, will pick out the articles offering the best quality. As a result, the share of lesser-quality articles in the stock will rise after each sale until eventually the stock will consist solely of lesser-quality articles. The stock of articles which is offered for sale will consequently no longer be attractive to the customer.

Bulk articles are also prepacked in closed disposable packagings to enable these to be offered for sale in shops. The prepackaging of bulk articles involves labour and costs which influence the selling price of the bulk articles. The disposable packagings, moreover, are detrimental to the environment.

Furthermore, delicate articles are damaged during the packaging. As a result of the use of closed packagings, condensation water is formed within the packaging, this adversely affecting the shelf life of some bulk articles (such as vegetables or fruit).

The customer cannot freely determine the quantity of bulk articles which he buys.

An object of the invention in to remedy the aforementioned drawbacks associated with the sale of bulk articles in a shop.

This object in achieved by using a device for the distribution of bulk articles as an apparatus in the sale of bulk articles in a shop, this device comprising a stock container and a conveyor, which can be driven so as to transport bulk articles, leaving the stock container along the discharge opening, and drop them into a packaging.

Consequently, the selling price of the articles will be lower than in the case of prepacked articles in view of the fact that there are no costs involved in packaging the articles. This is carried out, in fact, by the customer himself or by the shop assistant at the moment of sale.

Delicate articles are less heavily damaged and, in view of the fact that the customer can use re-usable packagings (a basket or shopping bag of his/her own, for example), the environment suffers less pollution.

The customer can precisely determine the quantity of articles which he wishes to buy, whilst he is unable to pick out the highest-quality articles. Vegetables or fruit also keep far longer in a stock container than in closed packagings. The stock container is indeed envisaged such that no condensation water can be formed.

The present invention is further illustrated with reference to the following description of a preferred embodiment thereof.

In this description, reference is made to the appended figures, of which:

DETAILED DESCRIPTION OF THE PREFERRED EMBODIMENT

The below-described device according to the present invention is a device for the distribution of potatoes in packagings, this device being envisaged for use in a shop or other point of sale in connection with the bulk-selling of potatoes.

Figure 3:
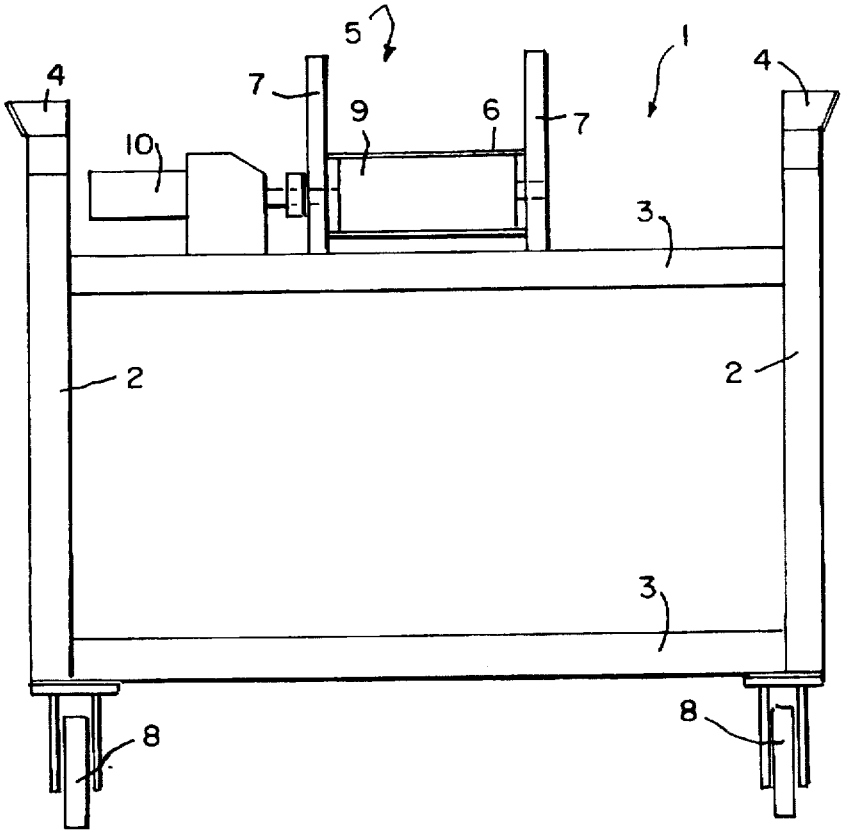

This device comprises a rectangular supporting structure (1) (see FIG. 3) comprising four vertical steel tubes (2) which are disposed two by two one opposite the other. The vertical tubes (2) are joined together on two levels by horizontal steel tubes (3). The vertical tubes (2) project over one and the same length above the uppermost horizontal tubes (3) and have an uppermost extremity (4) in which the legs (19) of the stock container (11) can be inserted over a limited length. The latter will be further discussed later.

The supporting structure (1) in provided at the bottom with lockable castors (8).

To two uppermost horizontal tubes (3) there is fastened the chassis (5) of the conveyor belt (6). This chassis (5) essentially comprises two parallel vertical plates (7), which extend according to the direction of an axis of symmetry of the supporting structure (1).

The plates (7) project with one extremity farther past the vertical tubes (3) of the supporting structure (1) than with the other extremity. The edge where the plates (7) project the farthest are hereinafter referred to as the front side of the supporting structure (1). The other edge is referred to as the rear side of the supporting structure (1).

In the proximity of both extremities of the plates (7), there are provided between these plates (7) respective guide rollers (9) for the conveyor belt (6). These guide rollers (9) are provided on mounted axles which extend virtually perpendicular to the plates (7) between the two plates (7).

One of the two axles, preferably the axle of the guide roller (9) on the rear side of the supporting structure (1), can be driven by an of an electric motor (10), which is disposed next to one of the two plates (7) on the supporting structure (1), or the guide roller (9) is of the drum-reducer type with built-in motor.

The conveyor belt (6) encloses the two guide rollers (9), so that the conveyor belt (6) revolves over the guide rollers (9) once the electric motor (10) is switched on.

Figure 2:
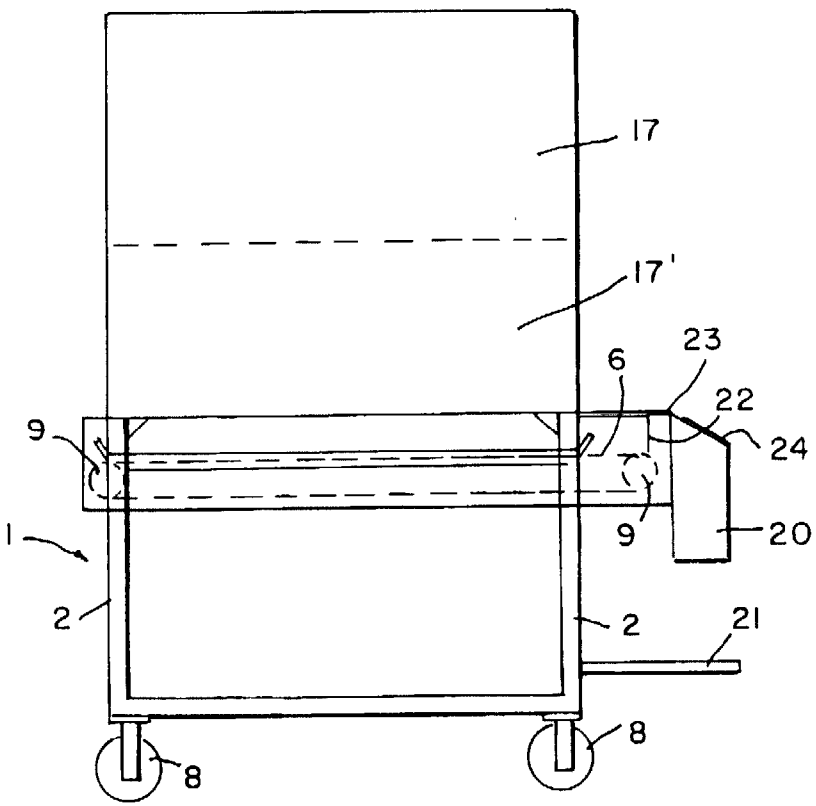
Figure 1:
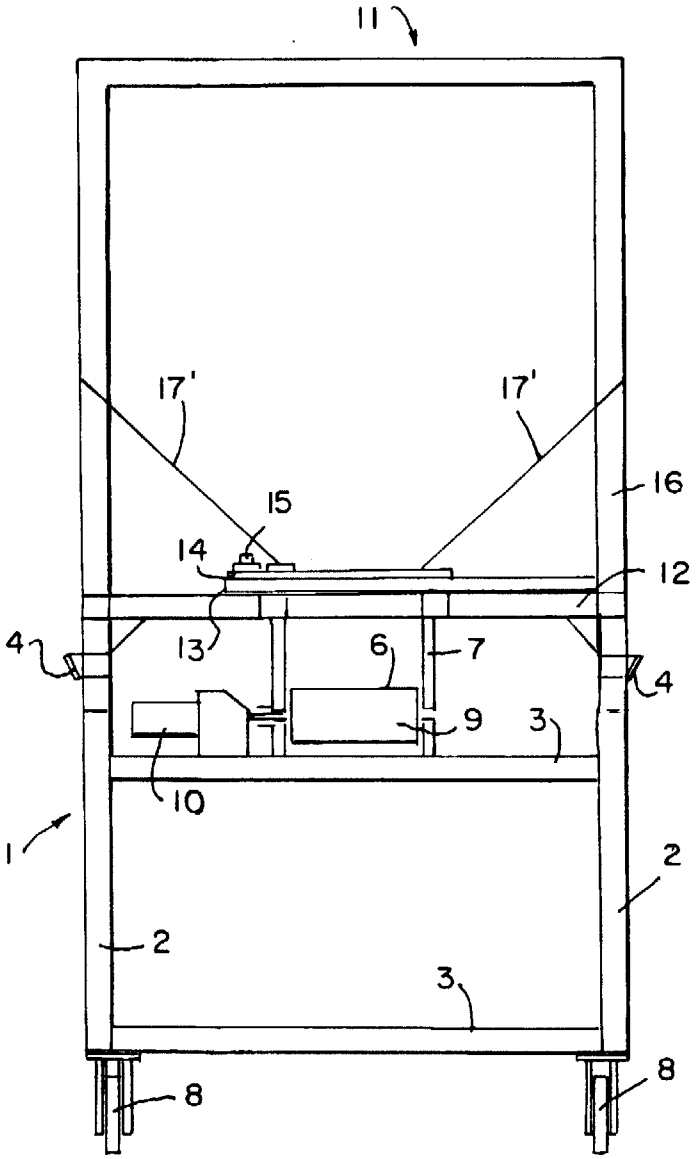
FIG. 1 portrays a vertical cross-section of a device for the distribution of bulk articles according to the invention, FIG. 2 portrays a side view of this device, FIG. 3 portrays a vertical cross-section of the supporting structure with conveyor belt of this device, FIG. 4 portrays a vertical cross-section of the removable stock container of this device.
Figure 4:
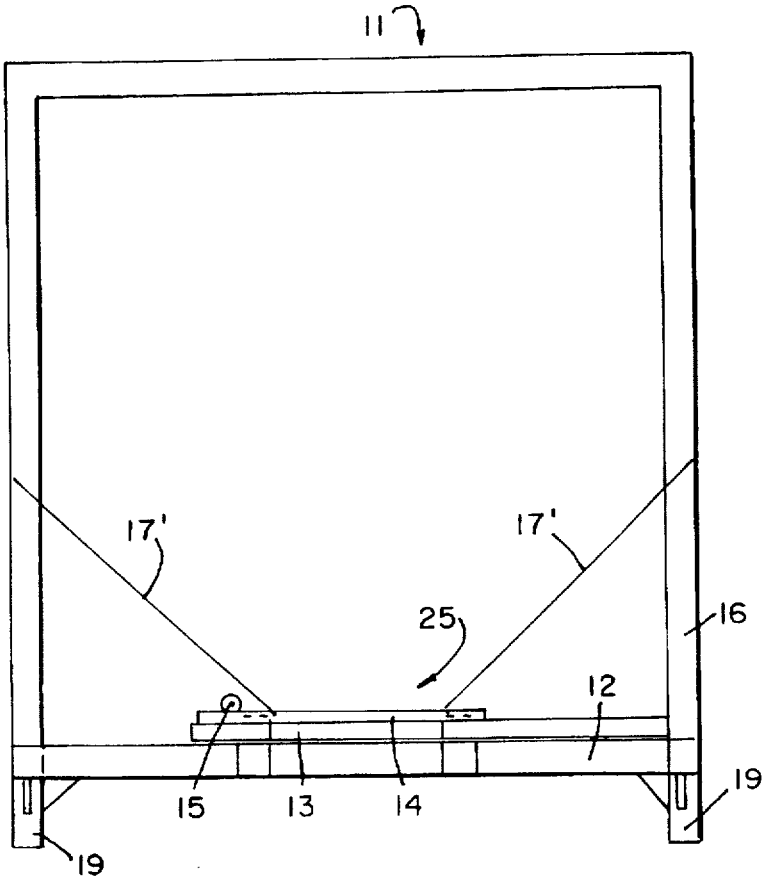

The device further comprises a removable stock container (11) (see FIG. 4). This stock container (11) comprises at the bottom a steel tube structure (12) on which there is centrally mounted a wooden slide valve (13), to which a toothed slat (14) is fastened. Above the toothed slat (14) a gearwheel (15) is fastened, which engages on the toothed slat (14). By rotating the gearwheel (15) in one or the other direction of rotation, the slide valve (13) can be opened or closed. The rotation of the gearwheel (15) is realized, for example, by means of a ratchet spanner.

To the steel tube structure (12) there is fastened a welded chassis (16), which is made up of steel angle-irons, in which smooth, wooden boards are fastened which form the walls of the stock container.

The stock container (11) has an uppermost portion, having walls (17) which enclose a rectangular space, and a lowermost portion, which is constructed in a funnel shape by virtue of two opposing walls (17') converging in the direction of the base.

The discharge opening (18), which is provided in the base of the stock container (11), can be opened or closed using the slide valve (13).

The steel tube structure (12) is provided at the bottom with four supporting legs (19), which can be slid into the top side of the vertical tubes (3) of the supporting structure (1).

The above-described embodiment of the stock container (11) is referred to as a slow-rotating container, by which is meant that it takes a relatively long time before it is empty and has to be replaced by another filled stock container. The potatoes must consequently be able to be kept in the stock container for a sufficiently long period. The shelf life is favourably influenced by the wooden walls of the stock container.

A fast-rotating container, which needs to be replaced relatively quickly, is preferably made completely of metal. In this stock container, the chassis (16), made up of steel angle-irons, is not provided. This chassis (16) is in fact not necessary, since the completely metal construction is sufficiently robust in its own right.

On the front side of the supporting structure, opposite the foremost extremity of the conveyor belt (6), a guide funnel (20) is disposed such that the potatoes ejected by the conveyor belt (6) fall into this guide funnel (20). The potatoes then fall via the open bottom side of this guide funnel (20) into a packaging placed beneath it.

Beneath the guide funnel (20), a horizontal supporting platform (21) for a packaging is fastened to the supporting structure (1).

Above the foremost extremity of the conveyor belt (6) there is provided a brush cut-off (22). Above this brush cut-off (22) and above the guide funnel there are fastened respective plexiglass cover plates (23, 24).

In addition, the supporting platform (20) also comprises a weighing device (not represented), which is connected to an adjustable control device (not represented), which is provided so as to switch off the electric motor (10) once a preset weight is weighed by the weighing device.

This device in used as follows: a stock container is filled with potatoes at the storage site and conveyed by means of a forklift truck to the supporting structure (1). The stock container (11) is subsequently placed with the supporting legs (19) in the open extremities of the vertical tubes (2) of the supporting structure (1).

The slide valve (13) is opened and the potatoes drop via the discharge opening (25) down onto the conveyor belt (6).

The device is placed at a location in the shop which is accessible to the customer and is now ready to be used.

A customer places a re-usable packaging on the supporting platform (21) and sets on the control device the desired weight of potatoes (by the pressing of keys, for example).

After this, the electric motor (10) is started (by means of a push button, for example).

The conveyor belt (6) is driven and transports the potatoes lying on it in the direction of the front side of the supporting structure (1).

Whenever there is space free on the portion of the conveyor belt below the discharge opening (25), this space in taken up by potatoes from the stock container (11). The potatoes are transported through the brush cut-off (28) and fall from the conveyor belt (6) into the guide funnel (20) and hence end up in the packaging.

Once the weighing device weighs the set weight, the electric motor (10) is switched off. There are no longer any potatoes conducted through the brush cut-off (22) and the fall of potatoes into the packaging is consequently immediately halted. In this way, the customer receives precisely the desired quantity of potatoes in his/her packaging. The price is printed on a label which has to be presented at the till or the price is determined following weighing at the till.

When the stock container is empty, it in replaced by another stock container filled with potatoes.

I claim:

1. A method of distributing bulk articles comprising the steps of filling a portable stock container, moving the stock container to a desired location, positioning a conveyor by the stock container, supplying bulk articles from the stock container to the conveyor, driving the conveyor for transporting bulk articles received from the stock container, and filling bulk articles in packaging.

2. The method of claim 1, further comprising weighing a quantity of bulk articles in the packaging by a weighing device and switching off the conveyor by an adjustable control device once a preset weight of bulk articles is weighed by the weighing device.

3. The method of claim 1, further comprising opening and closing a discharge opening in the stock container by a slide valve.

4. The method of claim 1, further comprising preventing bulk articles from falling from the conveyor by a brush cut-off when the conveyor is not operational.

5. The method of claim 1, further comprising supporting the stock container on a support and fastening the conveyor to the support and positioning the stock container on the conveyor.

6. The method of claim 1, wherein conveying the bulk articles comprises conveying potatoes.

7. Apparatus for distribution of bulk articles comprising a portable and removable stock container for transporting bulk articles, a conveyor for conveying bulk articles supplied by the stock container towards a packaging for receiving bulk articles.

8. The apparatus of claim 7, further comprising a brush cut-off associated with the conveyor to prevent bulk articles from falling from the conveyor when the conveyor is not operational.

9. The apparatus of claim 7, wherein the stock container comprises supporting legs on a lower side.

10. The apparatus of claim 7, wherein the stock container has smooth, wooden inner walls.

11. The apparatus of claim 7, further comprising a support for the stock container and means for fastening the conveyor to the supporting structure for positioning the stock container on the conveyor.

12. The apparatus of claim 7, wherein the bulk articles are potatoes.

13. The apparatus of claim 7, further comprising a weighing device for weighing the quantity of bulk articles in the packaging, a drive device for driving the conveyor, and an adjustable control device for switching off the drive device once a preset weight of bulk articles is weighed by the weighing device.

14. The apparatus of claim 7, wherein the stock container comprises a discharge opening and a slide valve for opening and closing the discharge opening.

15. The apparatus of claim 7, wherein the stock container comprises a discharge opening in a base and walls obliquely converging towards the base of the stock container.

* * * * *